US006112658A

United States Patent [19]

Gunther et al.

[11] Patent Number: 6,112,658

[45] Date of Patent: Sep. 5, 2000

[54] INTEGRATED AND COMPUTER CONTROLLED PRINTING PRESS, INSPECTION REWINDER AND DIE CUTTER SYSTEM

[75] Inventors: William G. Gunther, Guilford; Peter Moore, Clinton; Richard B. Abt, Branford; Richard J. Brining, Old Lyme; Anthony A. Penati, Killingworth, all of Conn.; Christopher C. McGeary, Allison Park, Pa.

[73] Assignee: George Schmitt & Company, Inc., Branford, Conn.

[21] Appl. No.: 09/257,482

[22] Filed: Feb. 25, 1999

[51] Int. Cl.[7] ..... B41J 9/00

[52] U.S. Cl. ..... 101/171

[58] Field of Search ..... 101/171; 382/181, 382/190, 195

[56] References Cited

U.S. PATENT DOCUMENTS

| | | | |
|---|---|---|---|
| 3,911,818 | 10/1975 | MacIlvaine | 101/426 |
| 4,177,730 | 12/1979 | Schriber et al. . | |
| 4,374,451 | 2/1983 | Miller . | |
| 4,411,194 | 10/1983 | Davidson, Jr. | 101/216 |
| 4,653,399 | 3/1987 | Kuehfuss . | |
| 4,830,380 | 5/1989 | Six . | |
| 4,877,323 | 10/1989 | Stillwagon | 356/23 |
| 4,951,223 | 8/1990 | Wales et al. . | |
| 5,076,163 | 12/1991 | Sainio | 101/181 |
| 5,098,130 | 3/1992 | Mikhail . | |
| 5,305,392 | 4/1994 | Longest, Jr. et al. | 382/8 |
| 5,357,448 | 10/1994 | Stanford | 364/526 |
| 5,383,392 | 1/1995 | Kowalewski et al. | 101/183 |
| 5,412,577 | 5/1995 | Sainio et al. | 364/469 |
| 5,440,402 | 8/1995 | Okuda et al. | 358/406 |
| 5,464,289 | 11/1995 | Beaudry . | |
| 5,570,633 | 11/1996 | Schultz et al. | 101/182 |

*Primary Examiner*—John S. Hilten
*Assistant Examiner*—Charles H. Nolan, Jr.
*Attorney, Agent, or Firm*—St. Onge Steward Johnston & Reens LLC

[57] ABSTRACT

An integrated and computer controlled printing press, inspection rewinder and die cutter system for manufacturing printed products from a web of material is provided, which generally comprises at least one rotary die cutter, a plurality of cameras, a plurality of networked computers electrically connected to the cameras for inspecting the print registers and the print to cut register of each product, and at least one monitor connected to the networked computers. The system uses an identification code for each product to precisely detect, track and record in a permanent format the defective and non-defective printed products at every stage of the manufacturing process and can also automatically adjust the die cutters to correct the cut to print registration in real time.

16 Claims, 8 Drawing Sheets

INTEGRATED AND COMPUTER CONTROLLED PRINTING PRESS, INSPECTION REWINDER AND DIE CUTTER SYSTEM

FIELD OF THE INVENTION

The invention relates to an apparatus for a printing press and rotary die cutting equipment and method of its use. More specifically, the invention relates to an on-line computer system to control and monitor a manufacturing process which includes the operational components of a printing press, an inspection rewinder and a rotary die cutter ("Operational Components").

BACKGROUND OF THE INVENTION

The use of printing presses and rotary die cutters are well known. These systems can perform several functions in addition to printing and cutting, such as error detection, registration control and splicing. Often, these functions have to be performed manually, which can result in low product quality and lost time during manufacturing. Thus, the use of automation in printing and cutting can be highly desirable to improve product quality and manufacturing efficiency, such as tracking accepted and rejected product.

Both manual and automatic methods have been used to inspect a product printed on a web of material. In a prior method of manual inspection, an operator visually inspected the web and physically flagged the defects while the web was being printed. Later, the flagged location on the web was manually relocated and the defective product removed. This manual method is overly time consuming.

In a prior method of automatic web inspection, a digital area array camera captured a shot of a large part of a web having a printed product and compared the digital image to a perfect or "golden" image of the product. This method, however, can use too much computer memory if a large image is captured. One solution to this problem has been to reduce the resolution of the captured image. This reduction in resolution, however, reduces the effectiveness of the system by allowing larger defects to go through undetected.

Other printing and cutting systems have attempted to effectively track defects in a material. U.S. Pat. No. 4,951,223 to Wales et al. discloses a web material inspection system for recording and storing an image of the web material and for reviewing the web image and detecting defects in the web. The Wales et al. apparatus can use a digital memory device to store the web image. Disadvantageously, the Wales et al. apparatus does not use a computer or network to track the web defects.

The use of identification codes during manufacturing is also known in the art. U.S. Pat. No. 4,830,380 to Six discloses a printed material bearing an identifying code for keeping track of a large number of non-identical printed patterns. The identifying code is printed on the sheet for each pattern and identifies which pattern it is. U.S. Pat. No. 4,374,451 to Miller discloses a method of assembling a CRT using a coded part that remains with the CRT during its assembly and further using a computer network to track the CRT through its manufacturing process. Disadvantageously, neither the Six apparatus nor the Miller method are capable of detecting errors.

The use of apparatus for maintaining the proper registration of printed and cut materials is also known in the art. U.S. Pat. No. 5,383,392 to Kowalewski et al. discloses a sheet registration control for adjusting the registration of a sheet as it passes from a printing section to a die-cutting section. To accomplish this, Kowalewski et al. discloses that placed between these two sections is a transfer section which uses computers to determine the registration of the sheet and to determine whether or not the sheet should be sped up or slowed down to bring the sheet in proper registration for the die-cutting section. Disadvantageously, the Kowalewski et al. apparatus does not disclose the tracking of the product from their rolls or the tracking of errors.

U.S. Pat. No. 4,177,730 to Schriber et al. discloses a method and apparatus for web printing that uses markings and scales to establish a reference position to which the rotatable members of the press are adjusted with respect to. The Schriber et al. apparatus, however, does not disclose the computer control or adjustment of the web press.

Apparatus for splicing a new roll to an old one is also known in the art. U.S. Pat. No. 5,464,289 to Beaudry et al. discloses an electrographic label printing system that includes an automatic shutoff roller and splicer for stopping the printing process and splicing a new roll of stock onto the old roll without rethreading the system.

None of the above systems, however, take advantage of computer networking to accomplish several of necessary monitoring and controlling functions of a printing press and die cutter in real-time, such as tracking the product defects and accumulating information about the defects throughout the manufacturing process.

What is desired, therefore, is an on-line computer controlled system for precisely detecting and tracking errors for a specific web roll in real-time for printing press and die cutting manufacturing system. Additionally, other printing and die cutting functions are desired to be accomplished in real-time through computer control, such as monitoring die cutting registration and detecting web splices.

SUMMARY OF THE INVENTION

Accordingly, an object of the present invention is to provide an integrated and computer controlled printing press, inspection rewinder and die cutter system that can precisely detect and track errors in real-time.

It is a further object of the present invention to provide an integrated and computer controlled printing press, inspection rewinder and die cutter system that can monitor and automatically adjust the registration of the die cutters.

It is yet another object of the present invention to provide an integrated and computer controlled printing press, inspection rewinder and die cutter system, wherein a local area network is used to transfer information between the various components of the system.

It is still another object of the present invention to provide an integrated and computer controlled printing press, inspection rewinder and die cutter system, wherein other die cutting adjustments and functions can be done in real-time such as die cutting registration and web splice detection.

It is still a further object of the present invention to provide an integrated and computer controlled printing press, inspection rewinder and die cutter system, in which the printing press, the inspection rewinder and the die cutter can share the same information concerning defective products contained on a specific web.

It is still yet another object of the present invention to provide an integrated and computer controlled printing press, inspection rewinder and die cutter system that uses a computer monitor to display the cut to print registration of the die cutters and the detected and tracked errors.

It is still yet a further object of the present invention to provide an integrated and computer controlled printing press, inspection rewinder and die cutter system that accumulates product quality information throughout the manufacturing process.

These objects of the invention are achieved by an integrated and computer controlled printing press, inspection rewinder and die cutter system for manufacturing printed products from a web of material, wherein the system generally comprises one or more of the Operational Components, a plurality of cameras, a plurality of networked computers electrically connected to the cameras for inspecting the print registers and the print to cut register of each product, and at least one monitor connected to the networked computers. The system uses an identification code for each product to precisely detect, track and record in a permanent format the defective and non-defective printed products at every stage of the manufacturing process and can adjust the die cutters to correct the cut to print registration in real time.

DETAILED DESCRIPTION OF THE INVENTION

Figure 1:
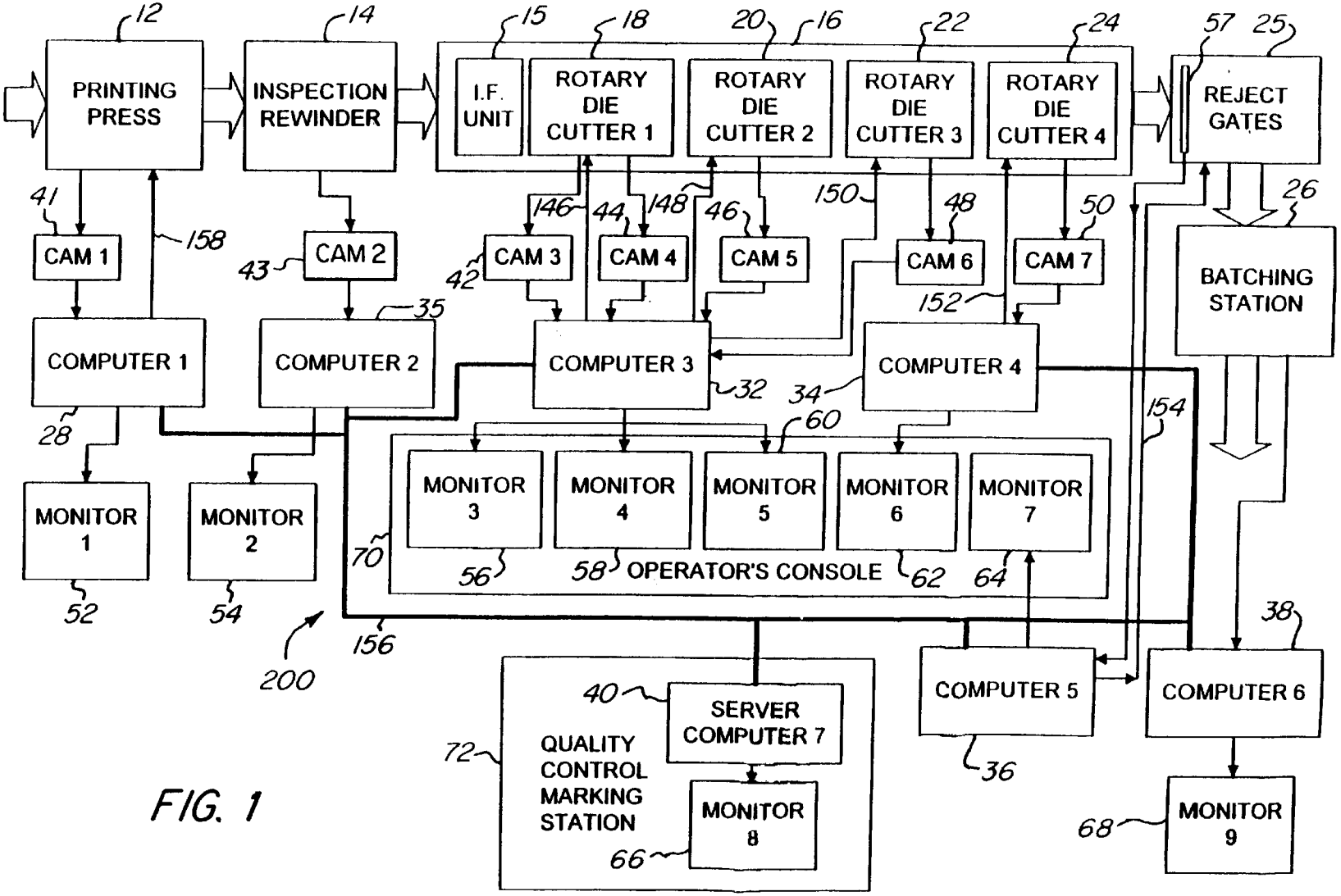
FIG. 1 is a block diagram of the integrated and computer controlled printing press, inspection rewinder and die cutter system in accordance with the invention.

FIG. 1 shows the preferred embodiment of the integrated and computer controlled printing press, inspection rewinder and die cutter system 10 in accordance with the present invention. The system 10 comprises a printing press 12, an inspection rewinder 14, a four station rotary die cutter 16, a batching station 26, a plurality of cameras and a plurality of networked computers with monitors. Additionally, the system comprises an operator's console 70 and a quality control marking station 72. Preferably, the system includes seven networked computers 28, 30, 32, 34, 36, 38, 40 used in conjunction with nine monitors 52, 54, 56, 58, 60, 62, 64, 66, 68 and seven cameras 41, 42, 43, 44, 46, 48, 50.

The system 10 preferably includes seven networked computers 28, 30, 32, 34, 36, 38, 40 and nine monitors 52, 54, 56, 58, 60, 62, 64, 66, 68 that are connected through a local area network (LAN) to provide in real-time the features of product and error tracking, die cutting registration and web splice detection. The system 10 inspects product 93 for print register defects originating in the printing press and cut to print register defects originating in the die cutter. Each product has an identification code to which all defect information is tied to and stored with on the LAN. This defect information is sent to a computer server 40 which stores the information and sends the information to the reject gates. The defect information is also available to operators through the nine monitors to verify the accuracy of the process. The system 10 can further interact with a longitudinal register control to provide the required corrective actions over electrical connections 146, 148, 150, 152, without intervention of an operator.

The system 10 controls the accept-reject gate 25 and rejects nonconforming products based upon: (1) random defects found through manual or automatic inspection during the printing process; (2) defects from print registration error between two or more colors; and (3) defects from cut to print registration originating during the die cutting process.

The equipment of the printing press 12 includes a computer 28, a 17 inch monitor touch screen 52, ink jet printer, camera 41, color register detection system, temperature sensor, conductivity sensor, operator intervention panel, color density monitor, nip pressure sensors, roll splice detector, and a mill splice detector. Preferably, a process control exists that can change one factor of the printing process over electrical connection 158 in response to another factor, such as the temperature, the pH level or the viscosity of the ink. For instance, if a lower printing press speed is desired, then the system will increase the viscosity of the ink.

The printing press prints for each row of product a Roll ID/Serial Number 96 to specifically identify a web roll and a row of product. Additionally, each lane of product is provided with a lane number to identify each product when used with the Roll ID/Serial Number 96. The lane and Roll ID/Serial Number 96 numbers are used by the server computer 40 to track all defect information about each product. At any time, this identification can be used to access the data file of the corresponding product. Preferably, an ink jet printer prints the Roll ID/Serial Number 96 when the web is progressing through the printing press.

Figure 4:
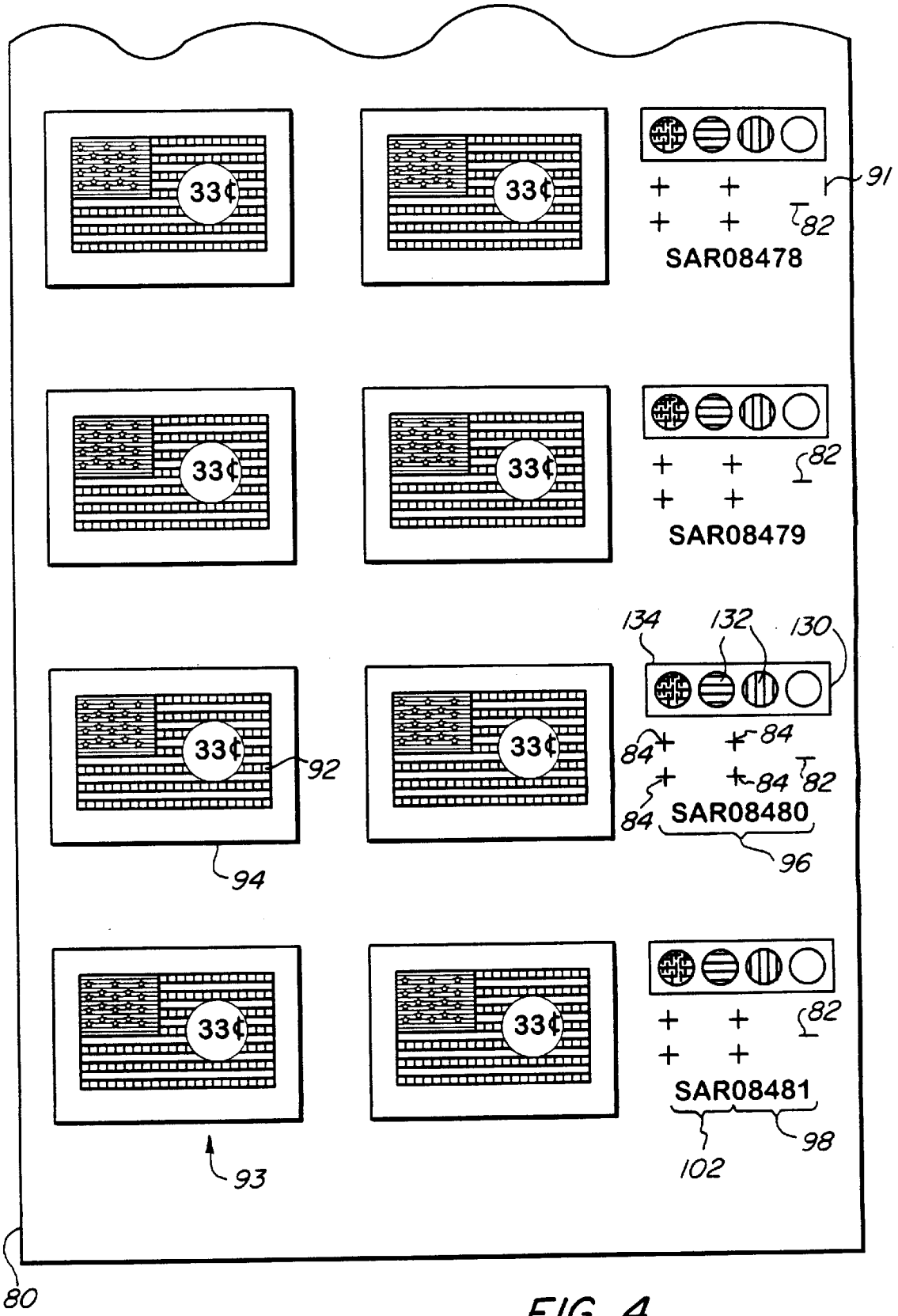
FIG. 4 is a top partial view of a web containing a plurality of product manufactured with the system of FIG. 1.

The printing press 12 preferably has eight stations such that it can print a product having up to eight different colors. The printing press 12 prints a registration mark for each color that is printed such that the accuracy of the printed colors with respect to one another can be determined. An example of the print registration marks is shown in FIG. 4 by reference numerals 130 and 132. Print registration can be determined from the location of the plurality of printed circles 132 with respect to the printed shape 134, which are each printed by a different stage of the printing press. The printing press 12 has located adjacent to it camera 41 which takes images of the web. These images are sent to computer 28 which determines the print registration of each printed color with respect to one another. In addition the computer verifies that all colors are present. If one print registration is outside of a predetermined accuracy limit, then a product or a row of products is determined to be defective. Furthermore, if the Roll ID/SN is missing or can't be read for a particular row, then that row is noted as being defective. This information related to defective products is sent to server computer 40 for storage and retrieval.

Preferably, the printing press also has a mechanism for the detection of random defects due to printing. In FIG. 1, an operator visually inspects the products for defects as it passes through the printing press 12 and notes on a computer where the defects are located. This information which includes the respective Roll ID/Serial Numbers 96 is also sent to server 40 for storage and retrieval.

The inspection rewinder unit 14 consists of camera 43, computer 30 and monitor 54 for visual inspection of the web. As the inspection rewinder unit 14 unwinds the web, the camera 43 captures the Roll ID/Serial Numbers 96 and sends it to computer 30. Computer 30 retrieves information relating to captured Roll ID/Serial Numbers 96 and displays the defective product information on monitor 54. An operator can inspect the web according to the displayed defective product information and can verify the information displayed at monitor 54, make adjustments at computer 30 to better specify which Roll ID/Serial Numbers 96 have defective products or input Roll ID/Serial Numbers 96 that were not previously noted as defective. The rewinder is designed to stop automatically when a defective serial number enters the machine.

A web aligning unit guides the side lay of the web 80 in register through the machine. This unit can track a line printed on the edge of the web 80 or the web edge directly, for cross control. The position of the side lay can be adjusted in real-time and set locally at the web aligner or, in the edge guide mode only, at the operator's console.

The equipment of the four station rotary die cutter 16 includes four rotary die cutters 18, 20, 22, 24 two computers 32, 34 and five cameras 42, 44, 46, 48 and 50. The computer 32 preferably uses a Hurletron register control and interacts with it to continually adjust die position from live camera video input without operator intervention. Computer 32 also reads serial code information and measures die cut 94 register at the first three die cut stations 18, 20, and 22. The computer 34 inspects each row of product 93 at the fourth die cutting station 24 and handles the reject gates 25 to remove nonconforming product. Five cameras 42, 44, 46, 48 and 50 are mounted over the four die stations 18, 20, 22, and 24 to read the serial code and measure the die cutting accuracy.

The rotary die cutter also includes an infeed unit 15 that isolates the stations, which follow, from variations caused by unwinding. An infeed nip unit is driven through the register control system. The infeed nip unit is individually and manually adjustable for pressure and on/off engagement as required for any particular job. A sensor is placed at the infeed nips to stop the machine if a web break is detected at the input nip unit.

The rotary die cutter further includes a splicer unwinder that consists of a microprocessor controlled two position turret unwind with splicing and festoon sections. The splicer unwinder preferably has automatic tension control and reel cross adjustments.

The batching station 26 includes a computer 38 that controls all product 93 on the conveyor after the reject gates to and including the batching gates. The computer 38 controls the stacking of product 93 to a desired count on lane by lane basis, and a 17 inch touch screen monitor 68 displays current stacking status and allows operator input.

The operator's console area 70 contains four monitors 56, 58, 60, and 62 that display camera images and measurement data from each die station. For convenience, the console area 70 can also contain the monitor 64 that displays the preview and audit functions.

Figure 5:
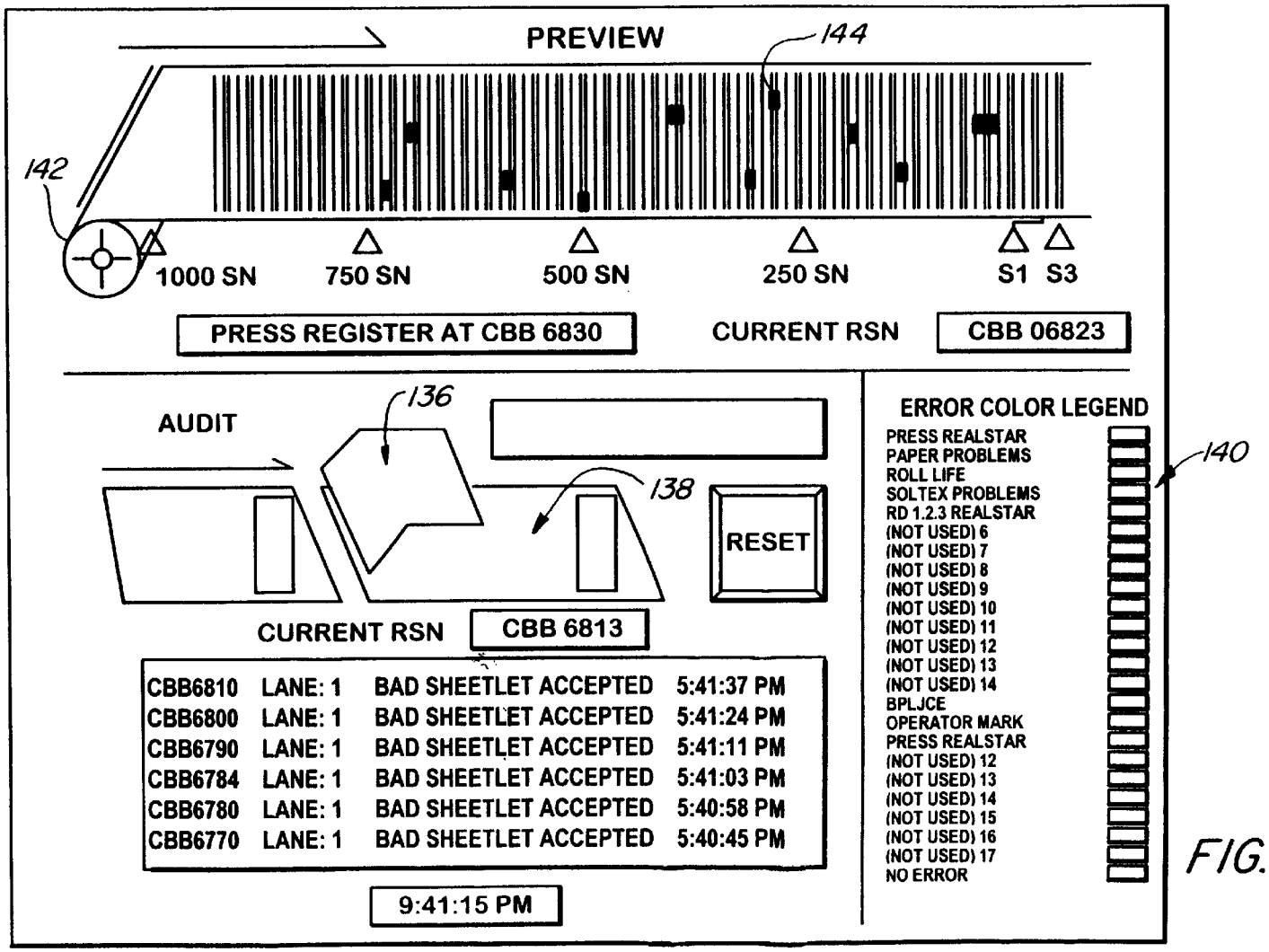
FIG. 5 is a front view of computer screen showing the preview/audit function of the system of FIG. 1.

Computer 36 controls both preview and audit functions and operates with monitor 64, which displays in a split screen both the preview and audit functions as shown in FIG. 5. The preview function monitors defects that are expected over the next 1,000 rows of product for the roll 142 being processed. The audit function confirms that the reject product was rejected at 136 and that the accepted product is accepted at 138. Both the preview and audit functions use color coding 140 to show what type of defects 144 are present.

The quality control marking station 72 includes a software program that allows quality control personnel to override the system as needed and mark the product 93 for acceptance or rejection independently from the error finding of the system.

The server computer 40, used with monitor 66, retrieves information over the local area network from the printing press 12, inspection rewinder 14, and the four station rotary die cutter 16, then compiles a record of the performance at each process and over these three machines and determines if a product, such as a booklet of stamps, is accepted or rejected when it reaches the reject gates. The computer 40 also compiles an archive record of all measurements and routing for all product within each roll.

The die cutter 16 includes four modular rotary die-cutting stations 18, 20, 22, 24 mounted in line. Each of the die cutting stations has the following components: a die cylinder, an anvil cylinder, bearer oilers/wipers, register nip rollers, web break detectors, die pressure gages, and register and inspection Vision cameras. Web break detectors are incorporated at each die station, and encoders are driven by the die cylinders for register and machine control use.

Register and inspection Vision cameras are integral with each die station to control and inspect the cut 94 to print 92 register. The cameras provide a 5.5/1 magnified view to the operator as well as an automatic register adjustment of the die cutting in relation to the print, based on pre-defined parameters. The cameras also feed data to a LAN to identify any non-acceptable product for later rejection as well as define other items such as roll changes, roll ID numbers etc.

The Hurletron register control unit has two separate motors, one of which controls the base speed and the other controls the correction speed. The register control feeds the preprinted web 80 automatically in register with the die cutting of the second station 20, which is the master station. The first 18, third 22 and fourth 24 stations are then manually phased to the second station 20. The register control can be connected, one at a time, with any one of the other three stations 18, 22, or 24, which will then become the master station. The choice of the master station depends upon the specification of the products 93 run on the die cutter.

The first die cutting station 18 has a front side camera 42 and a backside camera 44 mounted respectively on the front side and the backside of the web 80. Two cameras are provided for the station 18 because it has the capability of die cutting on either the back or front side of the printed web 80. The three other die cutting stations 20, 22, 24 allow the die cut 94 on the face of the web 80 only. With this arrangement a broad range of stamp die cut products can be run on the machine as well as full width sheets. As designed, the second station 20 is the master station to be used for the die cutting operations requiring the most critical register accuracy.

The delivery portion of the machine consists of four distinct sections: a first vacuum conveyor, a conveyor section, a reject gates section 25, and a second vacuum conveyor. All sections have detection devices to shut down the machine in case of jams.

The first vacuum conveyor of the sliding bed type receives product 93 out of the last die cut station and runs at a slight over speed to provide web tension and product removal through the last station. The amount of vacuum applied is preferably adjustable.

The conveyor section simultaneously diverges, spreading out sideways, up to eight product 93 items across the web 80 and increases the space between each product item. If the product 93 is only one piece across the web 80, diverging is eliminated.

The reject gates section 25 consists of a computer controlled air diverting system (air gate) that causes any or all of up to 8 lanes of reject product (continuously or on a piece by piece mode) to be ejected to a reject collector located preferably above the lanes. The computer control uses the Roll ID/Serial Number 96 and it is driven by prior memory input from other operations or machines, via the local area network system (LAN), as well as by the inspection cameras 42, 44, 46, 48, 50 on the die cutting machine. The reject system keeps accurate count of acceptable, reject and total output products for accountability purposes and files these data to the LAN for future retrieval as required. Visible counters are also preferably installed for backup data. The LAN keeps all data on a roll by roll basis starting from the raw roll received from the mill through final packaging. The LAN has an uninterrupted power supply and a monitor/printer to access all data. The LAN master server is expected to be located in the production office.

The reject gate section 25 collects the rejected product in orientation by lanes, keeping the integrity of each lane, and allowing the reconciliation of the quantities of total input products, acceptable products and reject products, by lane. To detect whether or not a product was rejected, one or more fiberoptic eyes 57 can be used to detect the presence of product after the reject gates. The reject gates receive information from the LAN over electrical connection 154.

The second vacuum conveyor receives the acceptable product and carries it to a computer controlled counting and diverting air gate. The air gate diverts batches of exact count booklets alternatively to an upper and a lower conveyor belt, independently, lane by lane. The computer controls the counting and the action of the gate based upon prior memory input from the preceding operations. Counters are installed for redundancy of counting. The counted batches are collected, shingled on the conveyors, upper and lower, and are delivered to collecting bins.

The system 10 includes a freestanding operator's console 70 from which the operator can control all operations and visually inspect product quality. The control/inspection equipment located on the console are: motor drive controls, register controls, auxiliary equipment controls, four visual monitors 56, 58, 60, 62 to display the measured cut 94 to print 92 register at each die station, a monitor to display preview and audit functions 64, on-board computers and connection devices to the LAN, and an alarm system for various functions. The four monitors 56, 58, 60, 62 display the cut to print register using a 5.5/1 magnification.

Figure 2:
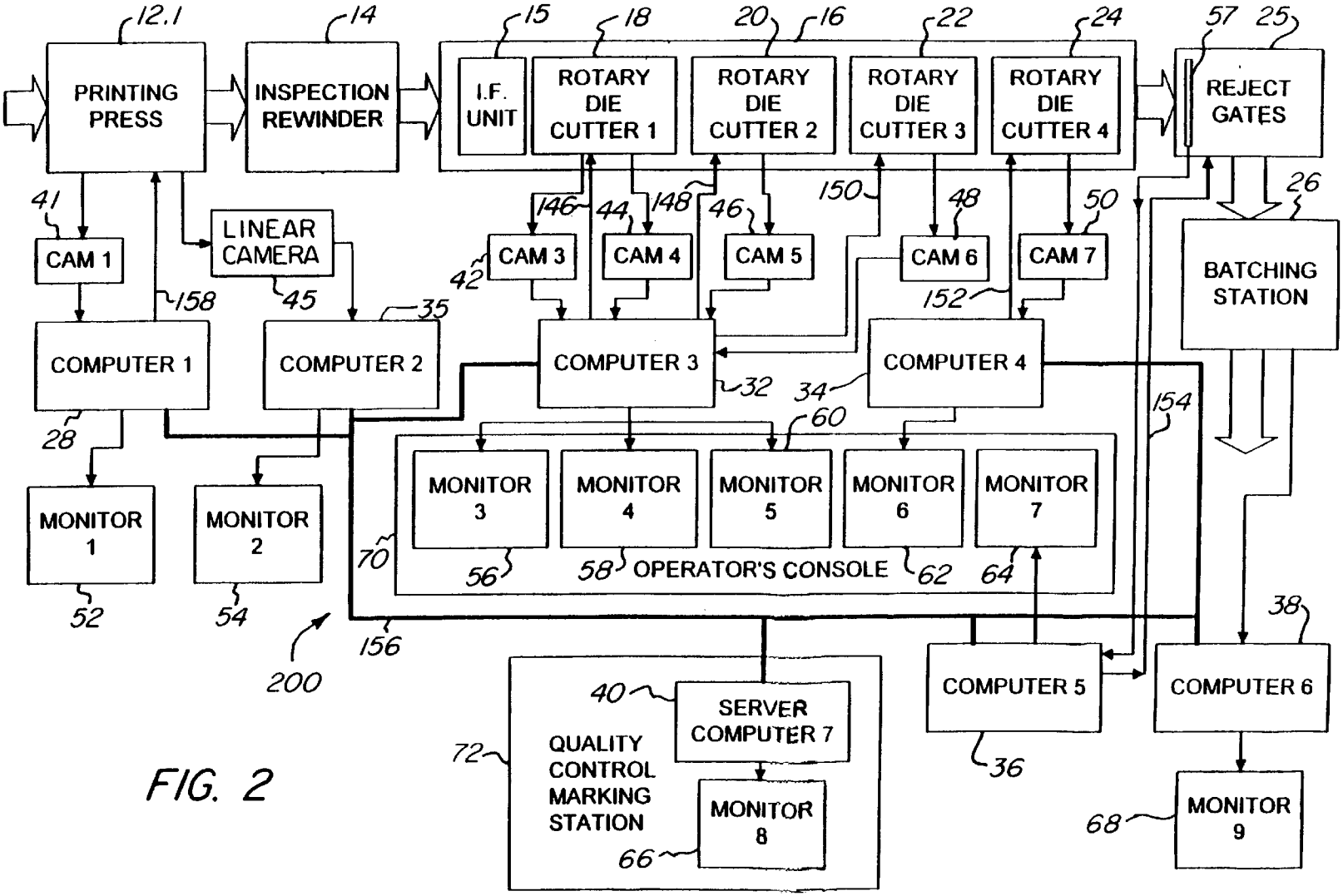
FIG. 2 is a block diagram of another embodiment of the integrated and computer controlled printing press, inspection rewinder and die cutter system of FIG. 1.

FIG. 2 shows the second embodiment of the invention, system 200. The difference between the embodiments in FIGS. 1 and 2 is that the camera 43 and computer 30 associated with the inspection rewinder unit 14 in FIG. 1 are replaced by an additional printing press inspection system, which includes linear camera 45 and computer 35. Printing press 12.1 is essentially the same as 12 except for the connections to camera 45. Camera 45 is preferably a digital linear array camera that inspects the printed product after all colors have been applied to the web. The camera 45 continuously captures a linear slice of the web as it passes by and sends it to computer 30, which compares the linear slice and compares it to a digital linear slice of a perfect or "golden image" of the web. From this comparison, computer 35 determines whether each product has a random defect that resulted from the printing process.

Figure 3:
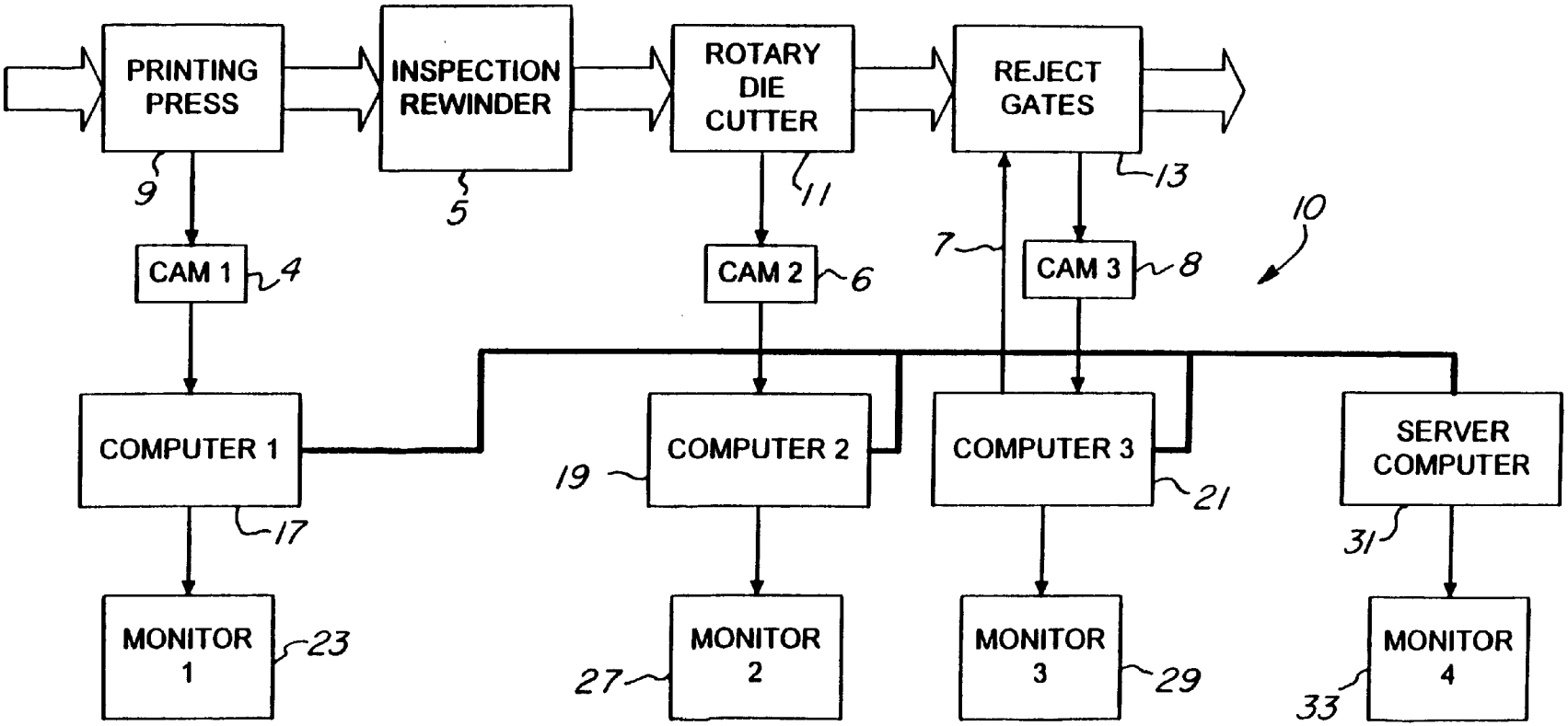
FIG. 3 is a block diagram of a third embodiment of the integrated and computer controlled printing press, inspection rewinder and die cutter system of FIG. 1.

FIG. 3 shows the third embodiment of the invention, which is a simplified embodiment of FIG. 1, but still employs the principles of the invention described herein. This system 100 has a printing press 9 an inspection rewinder 5, a rotary die cutter 11, a reject gates section 13, three cameras 4, 6, 8, three computers 17, 19, 21 networked together with a server computer 31, and four monitors 23, 27, 29, 33, one connected to each computer.

The first camera 4 views the web and sends the data to computer 17. Computer 17 inspects the image from camera 4 to find defects in the printing registration. This information concerning product defects is sent to server computer 31 and saved in a software data file created for a specific web roll. Camera 6 views the web as it passes through a rotary die cutter 11 and sends a viewed image to computer 19, which inspects the cut to print registration of the products. Computer 19 also sends information concerning defects to server computer 31. Computer 21 takes the information from the computer server 31 and controls the reject gates through electrical connection 7 to reject the defective product. Camera 8 takes an image of the rejected product and sends it to computer 21 to verify that the defective products were rejected and the acceptable products were accepted. One or more fiberoptic eyes can be used in place of camera 8. Product can then be packaged according to the numbers of accepted product according to the software data file. Thus, information about the web roll was obtained from and shared between the printing press 9, the rotary die cutter 11 and the reject gates 13.

Referring to FIG. 4, the Roll ID/Serial Number 96 (Roll ID/SN) preferably consists of 8 characters. The first 3 characters make up the roll ID 98 and can have a value from A to Z. This allows for 17,576 unique roll IDs. The serial number 102 consists of the remaining 5 characters. Each of these characters can have a value from 0 to 9. This preferred format allows for 99,999 unique serial numbers. A serial number value of 00000 is preferably illegal. There is a separate Roll ID/SN 96 printed for each row on a roll.

Once a roll is printed, networked die cutting system 10 automatically creates a software data file for the roll. This software data file will use the Roll ID/SNs 96 to specify the defective product information. It should be noted that each data file could contain either defective product information, accepted product information or both and still fulfill the objectives of the invention.

The networked die cutting system 10 preferably has an inspection grid containing the data necessary to measure and inspect the print 92 to cut 94 registration of the die cutters. The inspection grid consists of the Hurletron eyemark 91, the Vision eyemark 82, the Roll ID/Serial Number 96 (Roll ID/SN), and from one to four alignment crosses 84. Preferably, each Roll ID/SN 96 is part of the inspection grid.

Referring mainly to FIG. 4, but also to FIGS. 1 and 2, the Hurletron eyemark 91 is used by the Hurletron registration control system in order to register the print 92 to the rotary die cut 94 is applied by the printing press 12 once every repeat or printing cylinder rotation. The Vision eyemark, however, is applied by the printing press 12 once every row. Computer 32 uses Hurletron eyemark 91 to trigger its picture taking. Therefore, the Hurletron eyemark 91 and the Vision eyemark 82 must be in a registration relative to one another. To facilitate easier detection of the Hurletron eyemark 91 and the Vision eyemark 82, it is preferable that these eyemarks have their own dedicated lanes. The location of the eyemarks 82, 91 and the Roll ID/SNs 96 in FIG. 4 are provided as an illustrative example. Many configurations, however, could be used to meet the objectives of the present invention.

During the printing process, the printing press creates the Vision eyemark 82, which computers 32 and 34 use to compare the print 92 to die cut 94 register. Computers 32, 34 find the center of the Vision eyemark 82 and compare it to the center of the alignment crosses 84 laid down by the rotary die stations. The fourth station inspection computer 34 also uses the Vision eyemark 82 to trigger its picture taking. The Vision eyemark 82 is preferably fixed at a size of 0.125" upstream/downstream and 0.25" crossweb. It is preferable that the size of the Vision eyemark 82 remains constant so that the computer can properly recognize it.

The individual rotary die stations each lay down a die cut alignment cross 84. The inspection grid allows for up to four alignment crosses 84, one for each die cutter. Each alignment cross 84 is preferably 0.140" by 0.140", but could be of any size. The inspection system determines the alignment within each station by measuring the relative position of the alignment cross 84 to the Vision eyemark 82. The monitors 56, 58, 60, 62 each display an image respectively from cameras 44, 46, 48, 50 showing the Vision eyemark 82, the alignment cross(es) 84 and the measured cross position error for each alignment cross 84.

Figure 6:
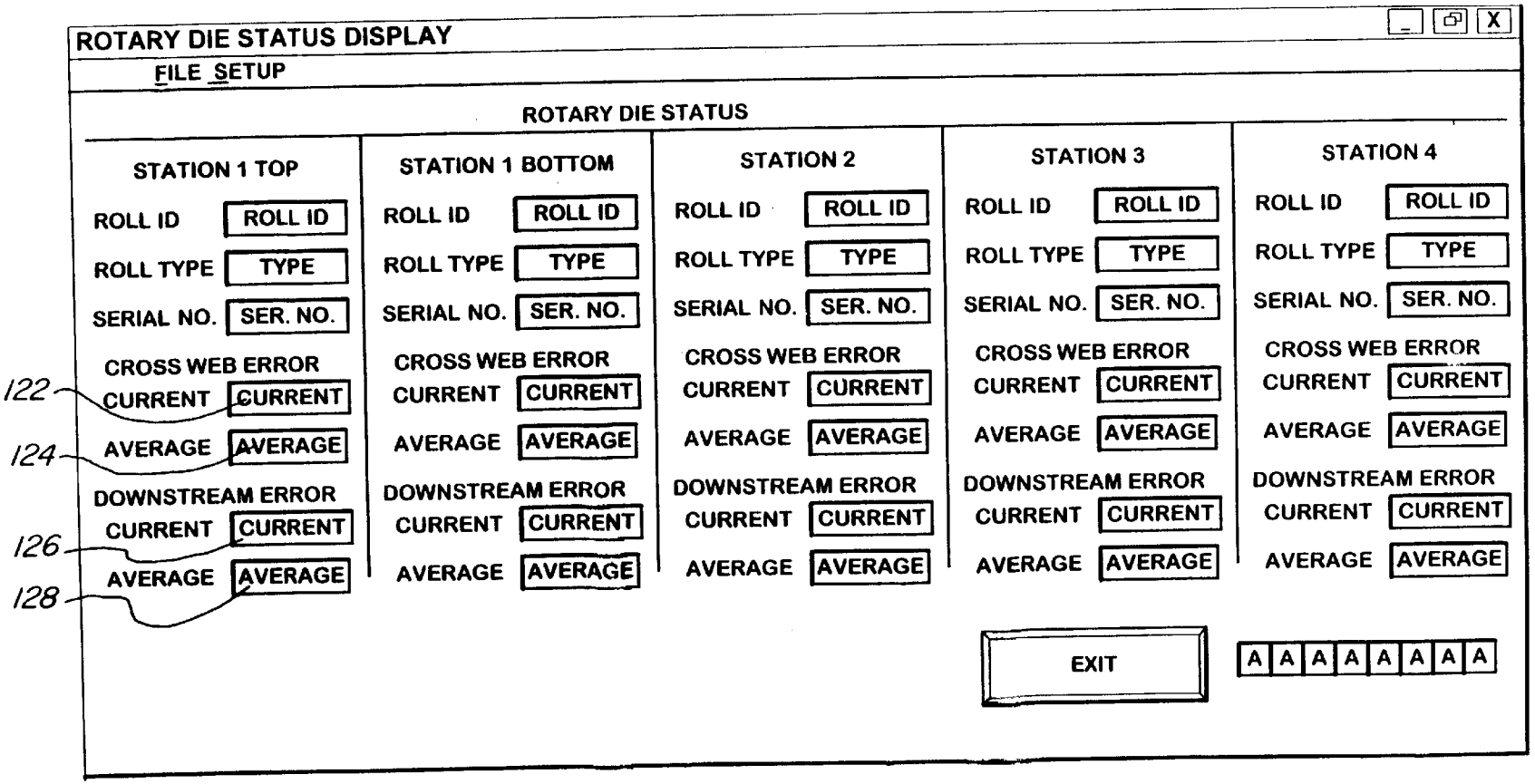
FIG. 6 is a front view of a computer dialog box reporting the status of the five cameras of the system of FIG. 1.

As shown in the dialog box of FIG. 6, the system 10 tracks for each die cutter 18, 20, 22, 24 the current cross web error 122, the current downstream error 126, the average current cross web error 124 and average downstream error 128. The average values can be calculated over a pre-determined time period or number of encoder counts 96. Each die cutter has manual cross adjustment and has manual rotary register adjustment.

There are two computers 32, 34 which handle the actual inspection. These communicate over an electrical communication 156 to a local area network (LAN) to the server computer 40, which accumulates and coordinates the inspection data. These three computers continuously send each other status messages, and will set alarms if communications are lost with any of the computers. Other inspection/monitoring systems such as the press monitoring system and the preview/audit system also communicate to the server computer 40 via the LAN.

Computer 32 monitors the print 92 to die cut 94 registration on the first three die cutter stations, 18, 20 and 22. It reports the variance at the bottom of each display, and changes the color of the displayed values based on the limits defined in the roll type file for the current roll ID. Computer 32 can also act a supervisory control for the Hurletron registration control system. It does this by comparing a running average of the second die cutting station 20 down web registration error to limits set in the supervisory control parameter display. When the control limits are exceeded, computer 32 automatically changes the setpoint on the Hurletron in a method similar to the way an operator would manually do it by electrically activating the advance or retard control.

Computer 32 handles the inspection for the first die cutting stations 18, 20, 22. The first die cutter station 18 has a top camera 44 looking at the top of the web 80 and a bottom camera 42 looking at the bottom of the web. Most jobs will use one or the other of these cameras. The remaining die cutter stations 20, 22, 24 have a single camera looking at the top of the web 80.

FIG. 4 shows a view of a web 80 of material having four rows of product 93, which in this example equals one repeat of the printing cylinder and of the master die cutting station. The Hurletron eyemark 91 is thus printed once every four rows. All three stations 18, 20, 22 have the Vision eyemark 82 under the cameras when the Hurletron eyemark 91 triggers the picture taking process, in which cameras 42, 44, 46 and 48 on computer 32 are synced together and capture images at the same time. These images are lit from a single EG&G strobe firing through a Fostec fiber optic bundle. The picture taking process for the second station 20 is triggered by a Keyence green LED sensor that detects and triggers on the Hurletron eyemark 91. Thus, the first three stations 18, 20, 22 inspect the Hurletron eyemark 91 for register control once per repeat. The picture taking process for the fourth station 24 is triggered by a Keyence green LED sensor that detects and triggers on the Vision eyemark 82. Thus, the fourth station inspects the Vision eyemark 82 once per row. All camera images are nominally 2" across the web 80 by 1.5" downstream.

The inspection is similar for each image taken by the cameras near the die cutters. In each case, the center of the Vision eyemark 82 is located within the image. The Roll ID/SN 96 is then read and run though an OCR (optical character recognition) algorithm to convert it from a picture to numbers and characters. The roll ID is then compared to a list of roll types to determine which measurements are used for the particular roll ID, including how many rows per repeat. The roll type also tells the system which stations are being used for this inspection. If the station is being used, the roll type tells the system where the alignment cross 84 should be located relative to the Vision eyemark 82. The system then finds the center of the alignment cross 84, and compares that location to the expected location. The position variance is then reported at the bottom of the screen, and is sent to the server computer 40. The variance is also used to set reject information for all the Roll ID/SNs 96 for the current repeat. This reject data is also sent to the server computer 40.

When the server computer 40 receives the current Roll ID/SN 96 for the third station 22 (or for the second station 20, if the third station 22 is not in use), it sends the reject information for that Roll ID/SN 96 and the ones before it to computer 34. This way, computer 34 has the critical reject information before it needs it, rather than having to request the information.

The first station 18 is a special case with respect to Roll ID/SNs. There is no Vision eyemark 82 or Roll ID/SN 96 printed on the bottom of the web 80. If the bottom camera 42 is being used for an inspection, it gets its positional information from the Vision eyemark 82 and Roll ID/SN 96 of the top camera 44.

The fourth station 24 has a single camera looking at the top of the web 80. This image is lit from a single EG&G strobe, firing through a Fostec fiber optic bundle. The picture taking process is triggered by a Keyence green LED sensor located on the fourth station 24. This sensor detects and triggers on the Vision eyemark 82. Thus, the fourth station 24 inspects once per row. The camera image is nominally 2" across the web 80 by 1.5" downstream.

Computer 34 monitors the print 92 to die cut 94 registration on the fourth station 24. It reports the variance at the bottom of the image display. Computer 34 also controls up to eight lanes of reject gates 25, based on reject information for each Roll ID/SN 96. It also monitors the product 93 entering and exiting the reject gates 25 to ensure that all product has entered the gates and gone where it should have. This monitoring information is sent to the preview/audit system for independent display and audit control.

Figure 8:
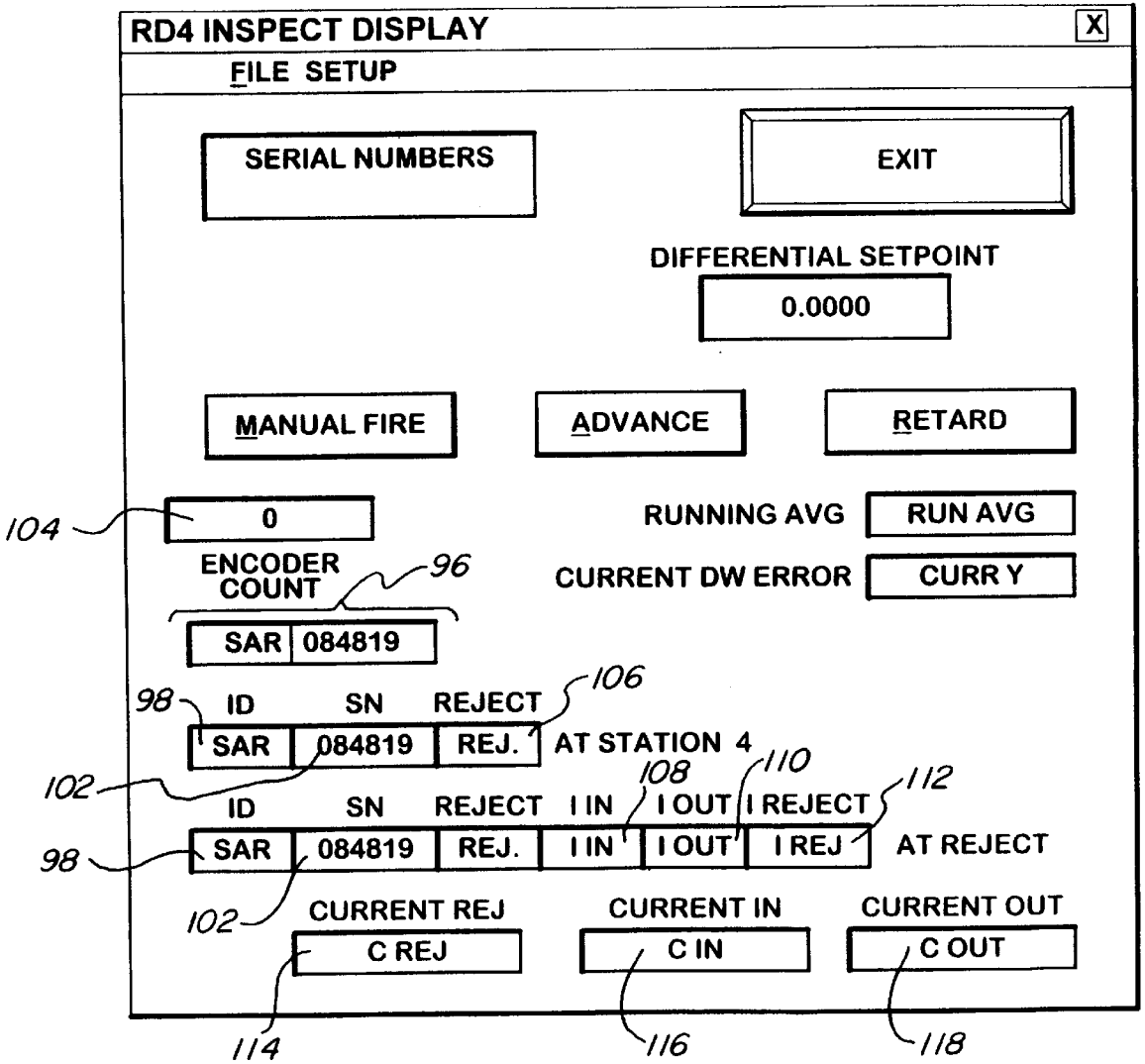
FIG. 8 is a front view of a computer dialog box reporting the status of the reject count at the fourth rotary die cutter and at the reject gates for the system of FIG. 1.

Through the use of an encoder attached to the anvil roll of the fourth station 24, the system 10 can effectively keep track of the rejected and accepted products. The encoder preferably generates 32 counts per revolution, or 1 count every 13¾". When the camera image at the fourth station 24 is taken, the current encoder count 104 is saved, and predicted encoder count values are calculated for the reject input 108, reject command 112, and reject/accept output positions 110. These values are shown in the dialog box of FIG. 8.

The predicted encoder counts 104 are then verified by comparing them to the counts at the reject gates 25. Every 10 milliseconds, a new encoder count is read. This is then compared to the predicted encoder count 104 values saved earlier. When the reject command count 112 is satisfied, the reject command count for the Roll ID/SN 96 is sent to the gates. When the reject input count 108 is satisfied, the sensors on the input side of the reject gates 25 are read to determine the input count 116 at the reject gates. When the reject/accept output count 110 is satisfied, the sensors for both the accept track and the reject track are read to determine the acceptable product output count 118 and the reject count 114. All sensor readings are sent to the server computer 40.

The Roll ID/SN 96 is also compared to the previous Roll ID/SN. If the roll ID has changed, or there is a gap in the serial numbers, then this signifies a splice. In this case, the rows on either side of the splice are rejected. The reject data sent up from the server computer 40 is also compared to this Roll ID/SN 96, and any previous reject commands for this Roll ID/SN are also applied here.

The server computer 40 coordinates the inspection data for the rotary die cutter and for all inspection data from the press through the final product. This inspection data is tracked using the Roll ID/SN 96 that is marked on each printed row. This Roll ID/SN 96 allows the system to track errors throughout the printing process.

Figure 7:
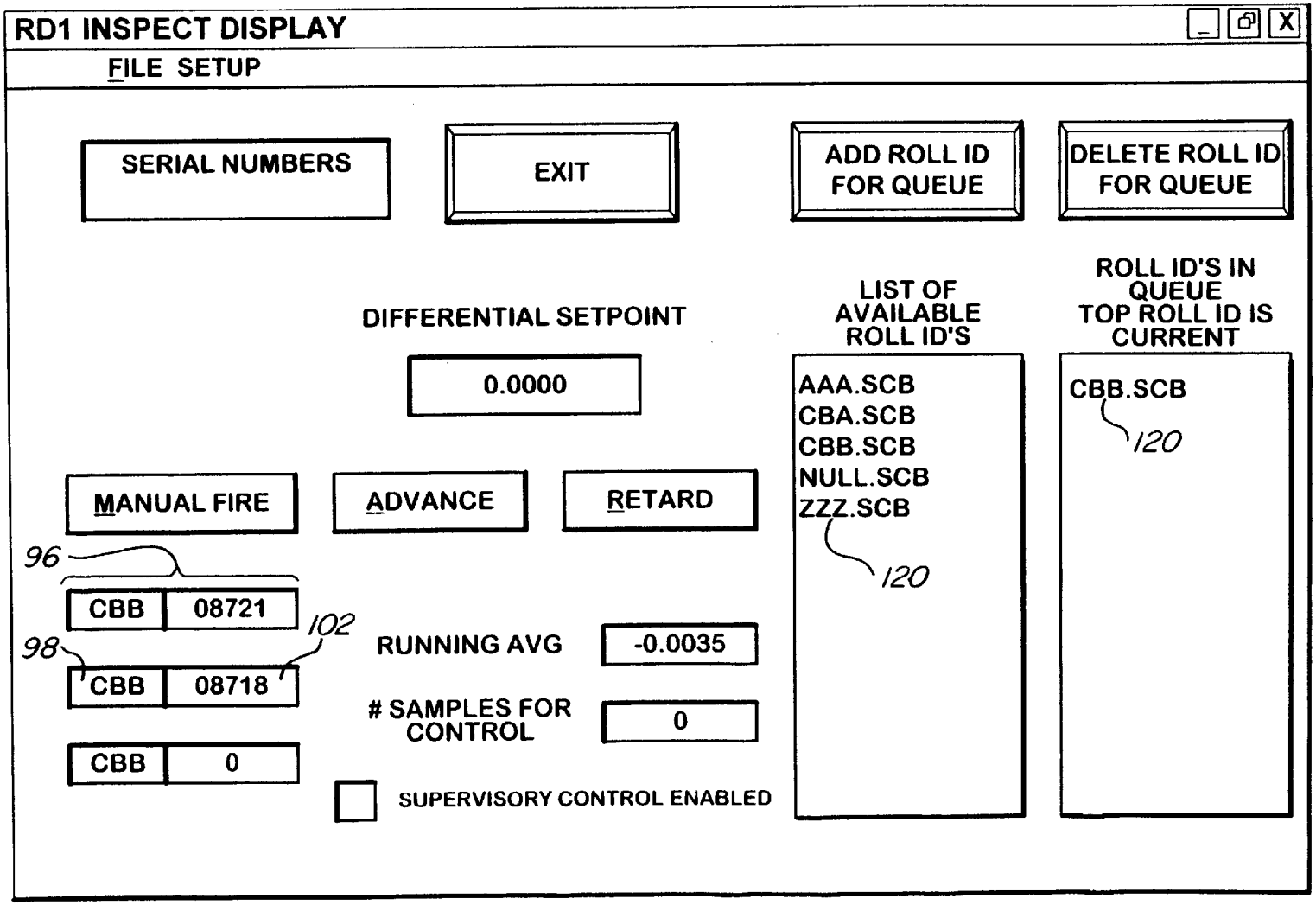
FIG. 7 is a front view of a computer dialog box showing the selection of the roll type for the system of FIG. 1.

How the server works will now be described. Before a roll is printed on the press, the operator uses the roll type creation program on the server computer 40 to assign the coming roll ID to a roll type as shown in FIG. 7. There can be a unique roll type for each roll ID, if desired. The roll type file 120 contains the measurement layout for the specified roll ID(s).

Once the roll is printed, the press monitoring system will automatically create a software data file for the roll. The operator will be able to mark (or unmark) serial numbers as required for splices and/or quality control.

Once the roll ID has been assigned to a roll type, the roll can be run through the error tracking system, including the rotary die cutter. Note that there is an option to run without a Roll ID/SN 96. This option must be selected on each Inspection computers 32, 34. In this case, no rejecting of product 93 is done. However, as long as the Vision eyemark 82 and alignment crosses 84 exist, the inspection systems will make measurements using the parameters from a default roll type.

The server computer 40 receives a message from computer 32 each time it makes a measurement, assuming that the Roll ID/SN 96 is being read. This message is saved in a file tagged with the correct roll ID. The measurement data is also used to update the software data file for the roll ID. The software data for the Roll ID/SN 96 detected in the third station 22 is also sent to computer 32 for use in determining the final reject command for the particular Roll ID/SN.

The fourth station 24 uses a set of rules to determine whether it should reject a row of product 93 at the reject gates 25. These rules include: 1) reject the product if the software data file lists the product as rejected by either the printing press or inspection rewinder; 2) reject a row if no serial number is found or if it is unreadable; 3) reject the rows on both sides of a gap in serial numbers 98, which indicates a splice in the web; 4) reject the rows on both sides of a change in roll ID 102, which indicates a different roll; 5) if the inspection at the first three stations 18, 20, 22 indicate the product is out of tolerance, reject the rows from the entire repeat; and 6) if the first three stations 18, 20, 22 are not configured to use serial numbers 98, then station four 24 will not use the reject data.

The server computer 40 also receives measurement results messages from computer 34, assuming that the Roll ID/SN 96 is being read. These messages are also saved in a file tagged with the correct roll ID.

The server computer 40 also receives messages from the press monitoring system and the inspection rewinder unit 14. These are also used to update the software data file for the appropriate roll ID.

The hardware for computer 32 preferably consists of the following: a Sirex (Tyan 1572 ATX motherboard) Pentium 200 MMX with 32 MB memory, an IDE CD-ROM drive, a 1.2 GB IDE hard drive, an ISA 10 BaseT ethernet card, an ATI S3 SVGA adapter, four ITI722 PCI framegrabber boards, four Sony XC-73 cameras, four Fujinon HF9A-2 lens with 0.5 mm extenders, an EG&G MV2060 strobe with Fostec 1>4 fiber optic bundle, three Viewsonic 15GS 15" SVGA monitors, an ABCD SVGA rotary switch (modified for low noise), Computerboards CIO-DIO24H digital 1/O card, two Computerboards SSR-RACK08 solid state relay panels, a Video Accessory Corp. VB-BBG Black Burst Generator, an APG Sync Box, and a Keyence FS-T1G sensor amplified with Aromat UZFRG1 & UXFXMR2 fiber optic & lens set.

The hardware for Computer 34 preferably consists of the following: a Sirex (Intel ATX motherboard) Pentium 200 with 32 MB memory, an IDE CDRom, a 1.2 GB IDE hard drive, a PCI 10BaseT ethernet card, an ATI S3 SVGA adapter, an ITI722 PCI framegrabber board, a Sony XC-73 camera, a Fujinon HF9A-2 lens with 0.5 mm extender, an EG&G MV2060 strobe with Fostec 1>1 fiber optic bundle, an AB SVGA rotary switch (modified for low noise), a Viewsonic 15GS 15" SVGA monitor, a Computerboards CIO-DIO24H digital I/O card, a Computerboards CIO-DIO24/CTR3 digital I/O card, two Computerboards SSR-Rack24 solid state relay panels, a BEI Encoder (E25BB-6R-SB-32-ABC-4469-LED-SM16), an APG Sync Box, and a Keyence FS-T1G sensor amplifier with Aromat UZFRG1 and UZFXMR2 fiber and optic lens set.

Computers 32 and 34 preferably share the following hardware: an APC Smart-UPS V/S 1440 battery backup, a NEMA 4 Keyboard and Pointing device, and a Rose Electronics Serve View+keyboard/mouse switch.

The hardware for Server Computer 40 preferably consists of the following hardware: a Gateway 2000 Pentium 200 Pro with 96MB memory, a SCSI CD-drive, a 2 GB SCSI hard drive, a 9 GB SCSI hard drive, a 1 GB JAZ drive, a PCI 100TX ethernet card, an ATI Mach 64 SVGA adapter, a Gateway 2000 17" SVGA monitor, a 3COM 10/100 16 port switch and an APC Smart-UPS 700 battery backup.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. A system for tracking errors during manufacture of a plurality of printed products printed on a web of material, comprising:

at least one rotary die cutter;

first and second cameras for producing viewed images of spaced segments of the web including print and cut registration symbols on the web;

a plurality of networked computers respectively electrically connected to said cameras to receive and store images produced by the cameras, with at least one of said images including print and cut registrations symbols located on the web, one of said plurality of networked computers inspecting the images of the web to compare print and cut registrations to determine whether a printed product is defective, said one networked computer including a software data file for storing and updating information of a defective status of printed products, and including software using the software data file to cause the rejection of defective printed products and enable visual verification that defective printed products are rejected; and at least one monitor electrically connected to one of the plurality of networked computers for displaying at least one of the viewed images.

2. The system for tracking errors of claim 1, further comprising:

a printing press for printing products having at least two printed colors on the web with print registrations for respective colors;

said plurality of networked computers having software for inspecting viewed images of the web for comparison with print registrations associated with each color to determine if printed products are defective; and a second monitor electrically connected a said networked computer for displaying viewed images associated with a second camera directed at the web.

3. The system for tracking errors of claim 2, further comprising:

wherein one of said cameras is a linear camera for producing third viewed images of the web; and one of said networked computers being electrically connected to said linear camera, said latter computer including a second software data file containing information concerning a desired viewed image and containing software to determine if a printed product observed by said linear camera is defective.

4. The system for tracking errors of claim 3, further comprising:

an inspection rewinder for rewinding a web of printed product;

a third camera for producing third viewed images of the web;

a third computer electrically connected to said third camera and networked with said networked computers, said plurality of networked computers providing said third computer with the software data file having the information of the defective status of products; and a third monitor for displaying the information of the defective status of products.

5. The system for tracking errors of claim 1, further comprising a reject gate located for separating the defective printed products from non-defective printed products, wherein one of the plurality of networked computers includes software to verify that the defective printed products were rejected at the reject gate.

6. A printing and rotary die cutting system for manufacturing a plurality of printed products contained on a web, comprising:

a printing press for printing a plurality of colors and for placing a print register mark on the web for each printed color to denote registration between the printed colors;

four rotary die cutters respectively positioned to cut a printed product from the web and for placing a cut register mark on the web, each cut register mark having an associated print register mark;

five cameras for producing viewed images of the web at locations that are associated with respective rotary die cutters, said printing press having a camera positioned to produce an image of the printed colors;

a plurality of networked computers including a server computer, said networked computers electrically connected to said cameras to receive viewed images therefrom and including software for inspecting the viewed images of the web to measure an accuracy of the print register of the printed colors with respect to each other and to measure an accuracy of the cut register mark with respect to the associated print register mark on the web and determine whether a printed product is defective, software including a software data file located in a said networked computer for containing a list of unique printed product identification codes, and verifying and updating the software data file that defective printed products have been rejected; and at least one monitor electrically connected to the plurality of networked computers for displaying the status of defective printed products.

7. The system for tracking errors of claim 6, further comprising a reject gate for separating the defective printed products from non-defective printed products, wherein one of said computers includes software to verify that defective printed products were rejected at the reject gates.

8. The rotary die cutting system of claim 6, further comprising a rewinder coupled to the web for rewinding the web of printed product, wherein at least one computer is electrically connected to the rewinder;

an infeed unit for isolating the rotary die cutters from variations caused by unwinding;

a reject gate for separating defective printed products from non-defective printed products, wherein a networked computer includes software to verify that defective printed products were rejected at the reject gate, and wherein a networked computer is electrically connected to the printing press, and wherein at least one camera is provided for viewing operative web portions cut by the rotary die cutters.

9. A method for manufacturing printed products contained on a web using a printing press and a rotary die cutting system having a plurality of rotary die cutters, the steps comprising:

placing a print register mark on the web for every color printed by a printing press to denote a print register of the printed colors;

placing a cut register mark on the web to denote a cut register of a rotary die cutter;

creating a first viewed image of the web after it passes through the printing press using a first camera electrically connected to a networked computer;

measuring an accuracy of a print register of each color with respect to each other color for each product by using at least one of the plurality of networked computers to compare from the first viewed image each print register mark with respect to the each other print register mark for each product;

determining if each product is defective by the accuracy of each print register mark with respect to each other print register marks;

creating a second viewed image of the web after it passes through the rotary die cutter using a second camera electrically connected to a said networked computer;

measuring an accuracy of a print to cut register for each product by using at least one of the plurality of networked computers to compare the print register and the cut register from the second viewed image;

determining if each product is defective by the accuracy of the cut to print register;

rejecting each defective product; and verifying that each defective product was removed by using one of the networked computers.

10. A method for manufacturing printed products according to claim 9, further comprising the step of automatically adjusting the cut register of the rotary die cutter so as to adjust the cut to print register.

11. A method for manufacturing printed products according to claim 9, further comprising the steps of:

creating a software data file containing an accuracy of the print register of each color with respect to each other color and an accuracy of the cut to print register for each product; and verifying that each defective product was removed by using one of the networked computers to review the software data file.

12. A method for manufacturing printed products according to claim 9, further comprising the steps of:

creating a software data file containing a list of defective products;

verifying that each defective product was removed by using one of the networked computers to review the software data file.

13. A method for manufacturing a printed product according to claim 9, further comprising the step of placing a mark on the web containing the product such that the defective product can be identified as being defective and be removed.

14. A method for manufacturing printed products contained on a web using a rotary die cutting system having a plurality of rotary die cutters, the steps comprising:

creating a unique identification code for each product;

creating a viewed image of the product after it passes through the die cutting system using at least one camera electrically connected to a plurality of networked computers;

inspecting the viewed image of the product for a defect using at least one of the plurality of networked computers;

creating a software data file containing a list of defective products and their unique identification codes;

rejecting the defective products; and verifying that the defective products were removed by using one of the networked computers to review the software data file.

15. A method for manufacturing a printed product according to claim 14, further comprising the steps of:

creating a software data file containing an accuracy of a cut to print register for each product;

verifying that the defective products were removed by using one of the networked computers to review the software data file.

16. A method for manufacturing a printed product according to claim 14, further comprising the steps of:

placing a first registration mark on the web to denote a print register of the printer;

placing a second registration mark on the web to denote a cut register of one of the rotary die cutters;

inspecting the viewed image of the product to determine an accuracy of a print to cut register by using the plurality of networked computers; and automatically adjusting the cut register of the one of the rotary die cutters so as to adjust the cut to print register.

* * * * *